US006497012B2

(12) United States Patent
Ide et al.

(10) Patent No.: US 6,497,012 B2
(45) Date of Patent: Dec. 24, 2002

(54) BUCKLE

(75) Inventors: Thad Ide, Knoxville, TN (US); P. David Halstead, Knoxville, TN (US)

(73) Assignee: Southern Impact Research Center, LLC, Knoxville, TN (US)

( * ) Notice: Subject to any disclaimer, the term of this patent is extended or adjusted under 35 U.S.C. 154(b) by 0 days.

(21) Appl. No.: 09/778,471

(22) Filed: Feb. 7, 2001

(65) Prior Publication Data

US 2002/0148081 A1 Oct. 17, 2002

(51) Int. Cl.[7] ..... A44B 11/02
(52) U.S. Cl. ..... 24/324
(58) Field of Search ..... 24/163 B, 323, 24/196–200, 324, 421, 425, DIG. 22; 280/808; 264/271.1, 275; 2/421, 425

(56) References Cited

U.S. PATENT DOCUMENTS

| | | | | | |
|---|---|---|---|---|---|
| 873,128 | A | * | 12/1907 | Holmes | 24/324 |
| 1,712,976 | A | * | 5/1929 | Blair | 24/324 |
| 1,753,696 | A | * | 4/1930 | Fenton | 24/324 |
| 1,902,557 | A | * | 3/1933 | Janes | 24/324 |
| 1,904,055 | A | * | 4/1933 | King | 24/324 |
| 2,693,625 | A | * | 11/1954 | Van Buren, Jr. | 24/324 |
| 2,905,991 | A | * | 9/1959 | Reiter | 24/324 |
| 3,237,257 | A | * | 3/1966 | Forsberg | 24/324 |
| 3,889,353 | A | | 6/1975 | Provi | |
| 3,977,839 | A | | 8/1976 | Palisin, Jr. | |
| 3,990,701 | A | | 11/1976 | Kim | |
| 4,177,320 | A | | 12/1979 | Yoshimura et al. | |
| 4,396,658 | A | | 8/1983 | Mettes et al. | |
| 4,628,004 | A | | 12/1986 | Nickola et al. | |
| 4,944,530 | A | | 7/1990 | Spurrier | |
| 5,091,260 | A | | 2/1992 | Wong | |
| 5,138,749 | A | * | 8/1992 | McCune et al. | 24/196 |
| 5,242,714 | A | | 9/1993 | Steele et al. | |
| 5,259,096 | A | * | 11/1993 | Grant | 24/324 |
| 5,281,435 | A | | 1/1994 | Buecher | |
| 5,345,656 | A | * | 9/1994 | Merritt | 24/115 H |
| 5,385,655 | A | | 1/1995 | Brent et al. | |
| 5,603,818 | A | | 2/1997 | Brent et al. | |
| 5,779,729 | A | | 7/1998 | Severini | |
| 5,974,637 | A | | 11/1999 | Tracy et al. | |
| 6,021,693 | A | * | 2/2000 | Feng-Sing | 264/275 X |
| 6,290,259 | B1 | * | 9/2001 | Drobot et al. | 280/808 |

OTHER PUBLICATIONS

Silver Metal Buckle (3 pages).
Black Plastic Buckle (3 pages).
White Plastic Buckle (3 pages).

* cited by examiner

*Primary Examiner*—Robert J. Sandy
*Assistant Examiner*—Ruth C. Rodriguez
(74) *Attorney, Agent, or Firm*—Luedeka, Neely & Graham PC

(57) ABSTRACT

A buckle for receiving a strap member and for snap-fitting to a snap stud located on a helmet. The buckle includes a metal member having opposite ends, with an aperture located between the ends and a slit on either side of the aperture. Each of the slits including a plurality of rugous surfaces suitable for frictionally engaging a strap member positionable there through, and a plastic material substantially encasing the metal member except that at least a portion of the rugous surfaces are not encased by the plastic material and remain exposed, and a region surrounding the aperture of the metal member is not encased and the plastic material located adjacent the aperture defines a barrel configured for receiving and mating in a snap-fit relationship with a snap-stud fastener located on a helmet with which the buckle is to be used.

6 Claims, 6 Drawing Sheets

BUCKLE

FIELD OF THE INVENTION

This invention relates generally to buckles. More particularly, this invention relates to a buckle of the type suitable for use with football helmet chin straps and which has improved corrosion resistance and strength properties as compared to conventional buckles.

BACKGROUND AND SUMMARY OF THE INVENTION

There is a need in the art for an improved buckle for use with chin straps of helmets such as football helmets. Buckles of metal construction are known. Conventional metal buckles have shortcomings in that they are readily bent and are susceptible to corrosion. Plastic buckles are also known. While the plastic buckles are corrosion resistant, they are weak and susceptible to breakage.

Accordingly it is an object of the present invention to provide an improved buckle device.

Still another object of the present invention is to provide a buckle device for use with chin straps of the type commonly used with sporting helmets.

Yet another object of the invention is to provide a buckle of the character described that has improved strength and corrosion resistance properties as compared to conventional buckles.

A still further object of the invention is to provide a buckle of the character described that is economical, uncomplicated in configuration and easily manufactured.

With regard to the foregoing and other objects, the present invention is directed to a buckle for receiving a strap member and for snap-fitting to a snap stud located on a helmet. The buckle device is particularly suitable for use with chin straps of the type commonly used with football helmets.

In a preferred embodiment, the buckle includes a metal member having opposite ends, with an aperture located between the ends and a slit on either side of the aperture. Each of the slits including a plurality of rugous surfaces suitable for frictionally engaging a strap member positionable there through, and a plastic material substantially encasing the metal member except that at least a portion of the rugous surfaces are not encased by the plastic material and remain exposed, and a region surrounding the aperture of the metal member is not encased and the plastic material located adjacent the aperture defines a barrel configured for receiving and mating in a snap-fit relationship with a snap-stud fastener located on a helmet with which the buckle is to be used.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
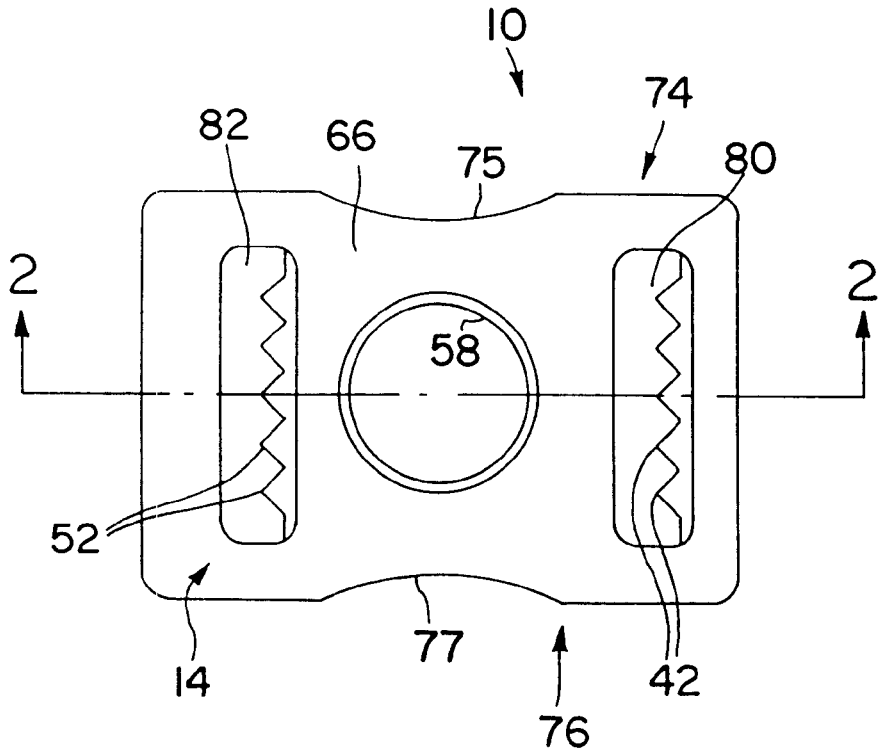
FIG. 1 is a top plan view showing a buckle in accordance with a preferred embodiment of the invention.
Figure 2:
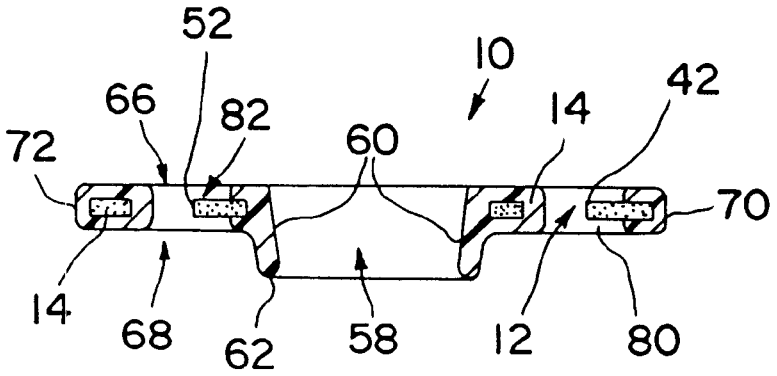
FIG. 2 is a cross-sectional view of the buckle of FIG. 1 taken along line 2—2.
Figure 3:
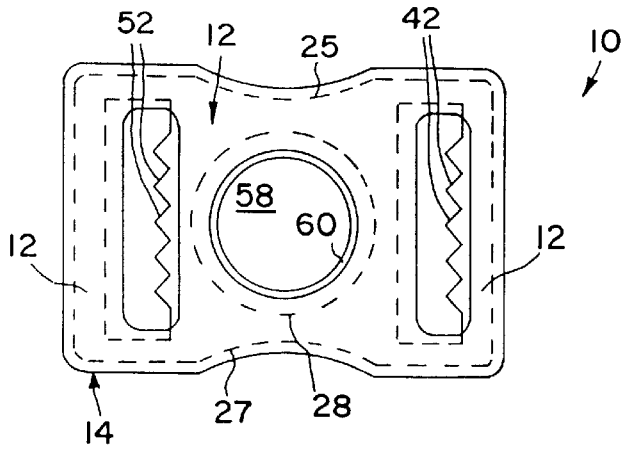
FIG. 3 is a top plan view of the buckle of FIG. 1 showing portions of a metal component of the buckle in phantom.
Figure 4:
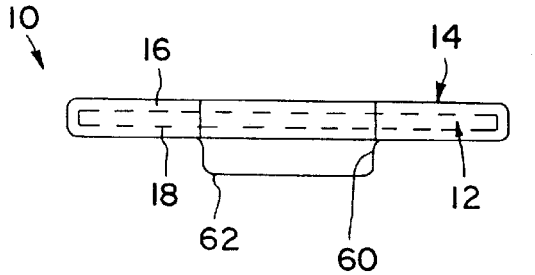
FIG. 4 is a side plan view of the buckle of FIG. 1 showing the metal component of the buckle in phantom.
Figure 5:
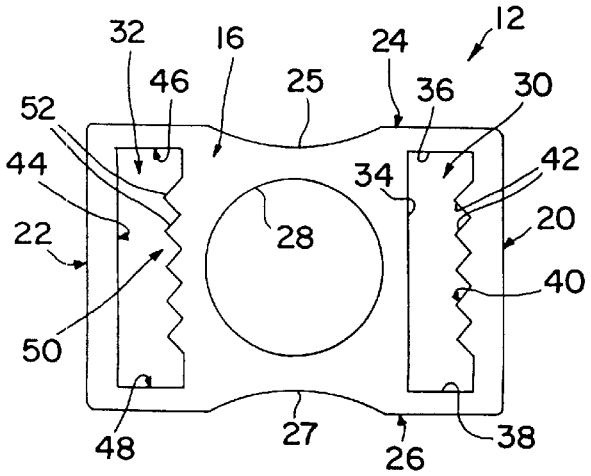
FIG. 5 is a top plan view of the metal component of the buckle of FIG. 1.

With reference to FIGS. 1–4, the invention relates to a buckle 10 that is particularly suitable for use with chin straps of sporting helmets, such as a football helmets. The buckle 10 includes a metal component 12 (FIG. 5) and a hard plastic component 14 partially encasing the metal component 12.

The metal component 12 is preferably of one piece, stamped steel construction, having a front surface 16 opposite a rear surface 18, opposite ends 20 and 22 and opposite sides 24 and 26, having slightly inwardly curved portions or indents 25 and 27, respectively. A substantially circular aperture 28 is centrally located and extends between the surfaces 16 and 18.

Slits 30 and 32 positioned adjacent the ends 20 and 22, respectively, extend between the surfaces 16 and 18 to permit passage of a strap member there through. The slit 30 is rectangular in cross-section, with smooth side 34 and smooth ends 36 and 38. Rugous side 40 is located adjacent the end 30 and includes a plurality of serrations or teeth 42 for frictionally engaging a portion of a strap member positioned through the slit 20. Similarly, the slit 32 includes smooth side 44 and smooth ends 46 and 48. Rugous side 50 is located adjacent the end 22 and includes a plurality of serrations or teeth 52 for frictionally engaging a portion of a strap member positioned through the slit 32.

Figure 6A:
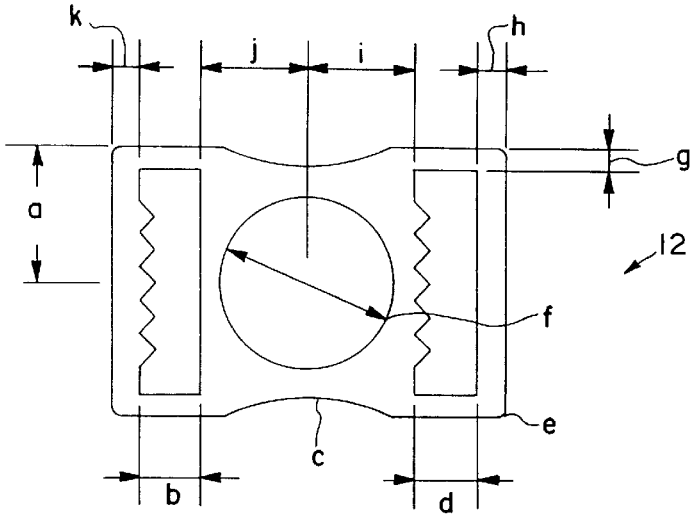
FIGS. 6*a*–6*c* show preferred dimensions of the metal component of the buckle of FIG. 1
Figure 6B:
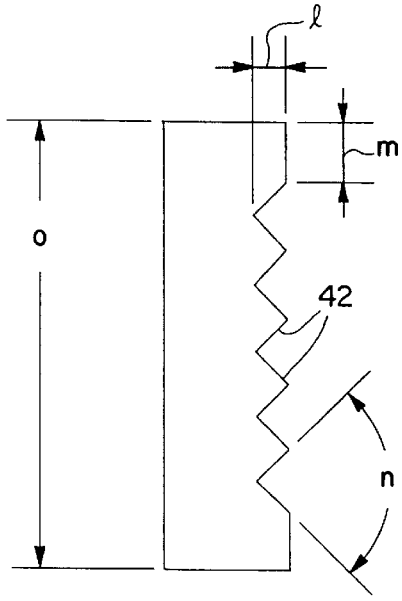
Figure 6C:
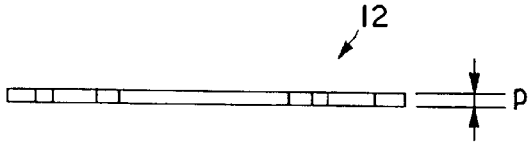

With reference to FIGS. 6*a*–*c* and Chart 1, there is provided an example of preferred dimensions of the metal component 12:

CHART 1

| Reference letter | Dimension (inches unless specified) |
|---|---|
| a | 0.4 |
| b | 0.188 |
| c | 0.62 (radius) |
| d | 0.188 |
| e | 0.025 (radius) |
| f | 0.524 |
| g | 0.063 |
| h | 0.088 |
| i | 0.325 |
| j | 0.325 |
| k | 0.088 |
| l | 0.05 |
| m | 0.087 |
| n | 90 degrees |
| o | 0.675 |
| p | 0.04 |

The hard plastic component 14 is preferably provided by a polymer such as a polycarbonate or a glass-filled nylon. The buckle 10 may be manufactured by placing the metal component 12 in a mold configured to provide the herein described plastic component 14 and introducing molten plastic to partially encase the metal component 12.

Figure 7:
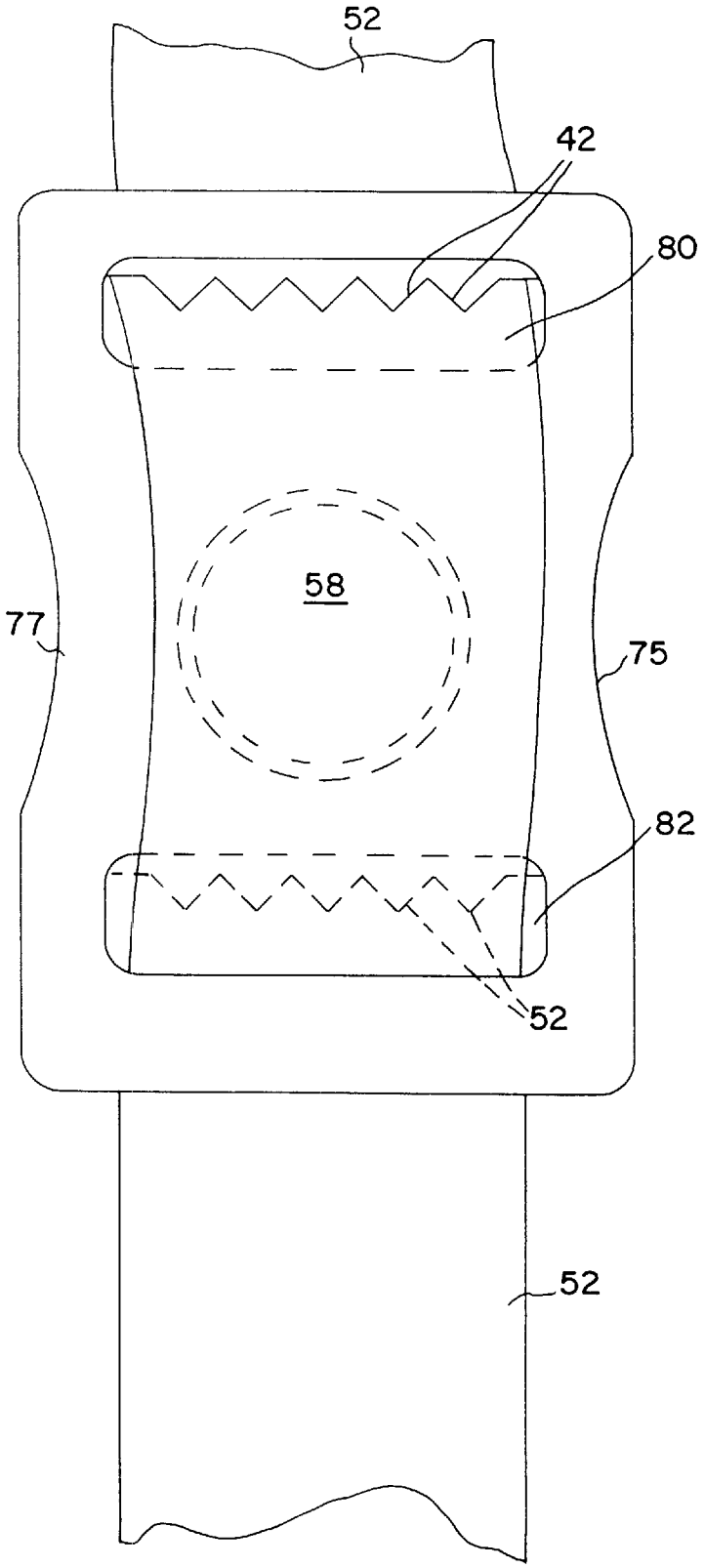
FIG. 7 is a perspective view showing the buckle of FIG. 1 installed on a strap and ready for fastening onto a helmet.

The hard plastic component 14 substantially encases the metal component 12, except that the rugous sides 40 and 50 (and hence the teeth or serrations 42, 52) are not encased by the plastic component 14 and remain exposed so that they can engage portions of a strap 52 (FIG. 7) placed through the slits 30 and 32, and a region surrounding the aperture 28 is not encased and defines a barrel 58 located adjacent the aperture 28 for receiving and mating in a snap-fit relationship with a conventional snap-stud fastener of the type used with metal buckles and located on a helmet with which to the buckle 10 is to be used.

Figure 9A:
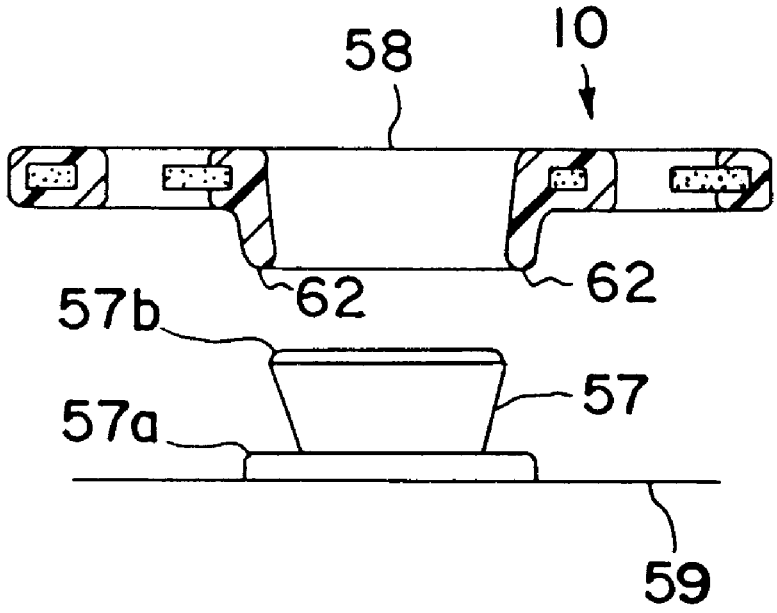
FIGS. 9*a* and 9*b* show fitting of the buckle of FIG. 1 onto a snap stud.
Figure 9B:
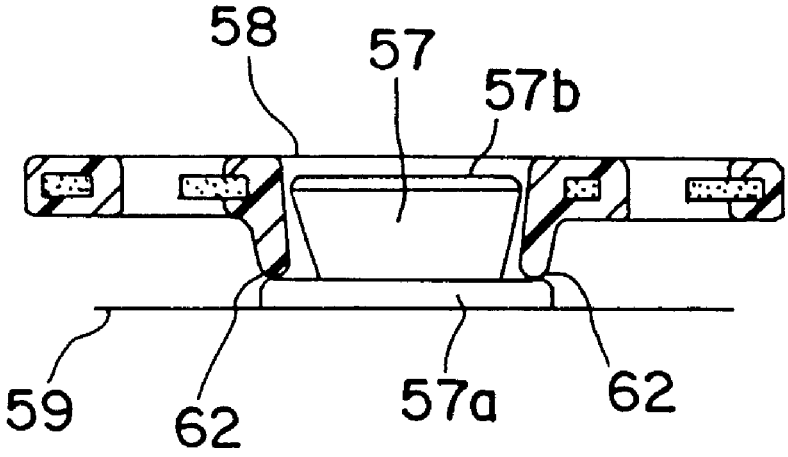

For example, with reference to FIGS. 9*a* and 9*b*, the barrel 58 is positionable to receive a snap stud 57 located on helmet shell 59. As will be noted, the sidewall 60 of the barrel 58 is preferably sloped so that the radius of the sidewall 60 increases in a direction away from lower end 62 of the barrel which is the end that is positioned over the snap-stud fastener 57 and lower end 62 rests on a lower circular ridge 57*a* of the stud 57. The lower end 62 of the barrel 58 is sized just slightly smaller than an upper circular ridge 57*b* at the upper end of the fastener 57 so that when the barrel 58 is urged over the fastener 57 a snap-fit results.

Accordingly, the resulting buckle 10 includes a front surface 66 opposite a rear surface 68, opposite ends 70 and 72 and opposite sides 74 and 76, having slightly inwardly curved portions or indents 75 and 77. The barrel 58 is centrally located so that it is coaxial with the aperture 28 and extends between the surfaces 66 and 68. Slits 80 and 82 are adjacent the slits 30 and 32 of the metal components 12 are adjacent the ends 70 and 72 to permit passage of the strap member 52.

Figure 8A:
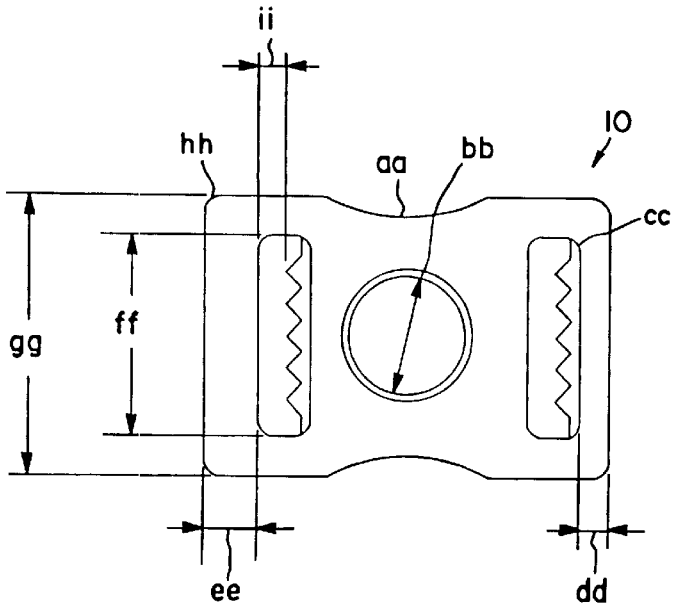
FIGS. 8*a*, 8*b* and 8*c* show preferred dimensions of the buckle of FIG. 1 and of the plastic component of the buckle of FIG. 1
Figure 8B:
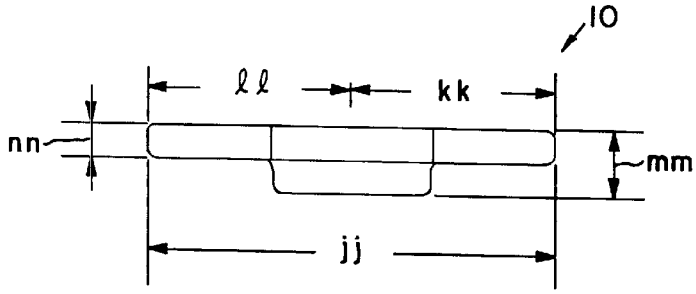
Figure 8C:
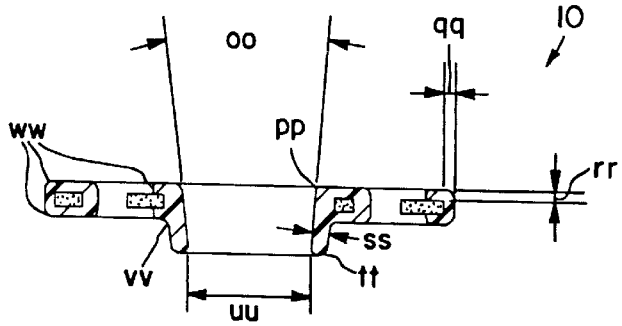

With reference to FIGS. 8*a*–8*c* and Chart 2, there is provided an example of preferred dimensions of the buckle 10 and of the plastic component 14:

CHART 2

| Reference letter | Dimension (inches unless specified) |
|---|---|
| aa | 0.592 (radius) |
| bb | 0.38 |
| cc | 0.056 (radius) |
| dd | 0.094 |
| ee | 0.169 |
| ff | 0.625 |
| gg | 0.862 |
| hh | 0.056 (radius) |
| ii | 0.088 |
| jj | 1.26 |
| kk | 0.631 |
| ll | 0.631 |
| mm | 0.20 |
| nn | 0.102 |
| oo | 11 degrees |
| pp | 0.025 (radius) |
| qq | 0.031 |
| rr | 0.031 |

CHART 2-continued

| Reference letter | Dimension (inches unless specified) |
|---|---|
| ss | 0.050 |
| tt | 0.025 (radius) |
| uu | 0.38 |
| vv | 0.025 (radius) |
| ww | 0.031 (radius) |

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A buckle for receiving a strap member and for snap-fitting to a snap stud located on a helmet, the buckle comprising:

a metal member having opposite ends, with an aperture located between the ends and a slit on either side of the aperture, each of the slits including a plurality of rugous surfaces suitable for frictionally engaging a strap member positionable there through, and a plastic material substantially encasing the metal member except that at least a portion of the rugous surfaces are not encased by the plastic material and remain exposed, and at least a portion of the aperture of the metal member is not encased and the plastic material located adjacent the aperture defines a barrel configured for receiving and mating in a snap-fit relationship with a snap-stud fastener located on a helmet with which the buckle is to be used.

2. The buckle of claim 1, wherein the rugous surfaces comprise a plurality of serrations.

3. The buckle of claim 1, wherein the barrel has a substantially circular cross-section of non-uniform radius so as to define a sloped internal sidewall positionable to engage a snap stud on a helmet.

4. The buckle of claim 1, wherein the plastic material comprises a glass filled nylon.

5. The buckle of claim 1, wherein the metal member has a front surface and an opposite rear surface and the buckle has a front surface and a rear surface defined by the plastic material and adjacent the front and rear surfaces of the metal member, respectively, and wherein the barrel extends between the front and rear surfaces of the buckle.

6. The buckle of claim 1, wherein the aperture is substantially circular.

* * * * *